US008177398B2

(12) United States Patent
Yao

(10) Patent No.: US 8,177,398 B2
(45) Date of Patent: May 15, 2012

(54) APPARATUS FOR FIXING LED LIGHT ENGINE TO LAMP FIXTURE

(75) Inventor: Pei-Chih Yao, Jhonghe (TW)

(73) Assignees: ACPA Energy Conversion Devices Co., Ltd., Jhonghe, Taipei County (TW); AQBT Quantam Bright Technologies Co., Ltd., Jhonghe, Taipei County (TW)

( * ) Notice: Subject to any disclaimer, the term of this patent is extended or adjusted under 35 U.S.C. 154(b) by 92 days.

(21) Appl. No.: 12/868,306

(22) Filed: Aug. 25, 2010

(65) Prior Publication Data

US 2011/0051419 A1 Mar. 3, 2011

(30) Foreign Application Priority Data

Aug. 26, 2009 (TW) ..... 98215731 U

(51) Int. Cl.
*F21V 29/00* (2006.01)

(52) U.S. Cl. ..... 362/373; 362/249.02; 362/431

(58) Field of Classification Search ..... 362/145, 362/153, 153.1, 249.01, 273, 373, 431
See application file for complete search history.

(56) References Cited

U.S. PATENT DOCUMENTS

| | | | | |
|---|---|---|---|---|
| 7,637,633 | B2 * | 12/2009 | Wong | 362/294 |
| 7,742,306 | B2 * | 6/2010 | Shuai et al. | 361/710 |
| 7,744,247 | B2 * | 6/2010 | Zhang et al. | 362/249.02 |
| 7,922,372 | B2 * | 4/2011 | Li | 362/373 |
| 8,070,306 | B2 * | 12/2011 | Ruud et al. | 362/101 |

* cited by examiner

*Primary Examiner* — Thomas Sember
(74) *Attorney, Agent, or Firm* — Muncy, Geissler, Olds & Lowe, PLLC

(57) ABSTRACT

An apparatus for fixing an LED light engine includes a lamp fixture base with a fixing seat, a light emitting module with a basal seat having a light source, a heat dissipating module with a plurality of heat dissipating fins having an embedding groove concavely formed at laterals of the heat dissipating fins and the heat dissipating module being installed around the light emitting module and provided for dissipating heat, a fixing device with first and second fixing elements coupled to the heat dissipating module, and the first and second fixing elements being embedded into the embedding grooves and having at least one fixing plate installed at edges of the first and second fixing elements and fixed to the fixing seat, so as to fixing the heat dissipating module with the lamp fixture base quickly and easily, while overcoming the repair and maintenance problems and providing an excellent practical application of an LED lighting device.

10 Claims, 4 Drawing Sheets

APPARATUS FOR FIXING LED LIGHT ENGINE TO LAMP FIXTURE

BACKGROUND OF THE INVENTION

1. Field of the Invention

The present invention relates to an apparatus for fixing an LED light engine to a lamp fixture, and more particularly to an apparatus provided for fixing an LED light engine which integrates a heat dissipating module and an LED light source to the lamp fixture, and the apparatus features convenient installation, removal, repair and maintenance.

2. Description of the Related Art

Compared with conventional light sources, present existing light sources, particularly light emitting diodes (LED) have the advantages of high efficiency, power saving, long life span, cold fluorescence, quick response and high color consistency, and thus the LEDs have become a key component for optoelectric and illumination industries and gradually replaced applications of a conventional incandescent light source.

In addition, life span and function of a light source substantially depending on the heat dissipation of the light source are key factors for the development and applications of present illumination devices, especially for high-watt LED lighting devices, and the installation of a heat dissipating module becomes very important. Since most of the LED lighting devices are installed outdoors, the issues of installation, removal, repair and maintenance must be taken into consideration. In general, the heat dissipating module of the LED lighting devices are installed at the periphery of the LED to form an integral unit as a light engine, and the heat dissipating module of the LED light engine is fixed to the lamp fixture base, and then the lamp fixture base and the lamp cover are combined. Since the heat dissipating module is comprised of a plurality of heat dissipating fins installed around the LED light source, therefore it is necessary to consider an appropriate positioning effect of the heat dissipating module. In addition, the connection between the heat dissipating module and the lamp fixture base is a main factor affecting the overall positioned assembly. However, the positioning structure between the heat dissipating module and the lamp fixture base of the present existing LED lighting devices is relatively complicated, and the complicated structure is unfavorable for a simple, easy and quick construction of a large number of lighting devices especially street lamps and definitely incurs construction safety and cost issues. Obviously, the installation and removal of the LED light engine using the conventional street lamp fixtures require further improvements.

In view of the drawbacks of the conventional apparatus for fixing the present existing LED light engine and its structural design, the inventor of the present invention conducted extensive researches and experiments, and finally provided a feasible solution and developed an apparatus for fixing an LED light engine to street lamp fixture that features quick and convenient installations and removals to serve the general public and promote the development of the related industry.

SUMMARY OF THE INVENTION

Therefore, it is a primary objective of the present invention to provide an apparatus for fixing an LED light engine to traditional lamp fixture, and the apparatus is capable of positioning and assembling the heat dissipating module of the LED light engine with a lamp fixture quickly and easily, while overcoming the drawbacks of the prior art by providing convenient installation, repair and maintenance.

To achieve the foregoing objective, the present invention provides an LED light engine with the fixing device comprising: a fixing seat; a light emitting module, including a basal seat, and a light source installed on the basal seat; a heat dissipating module, including a plurality of heat dissipating fins arranged with an interval apart from each other, an embedding groove concavely formed on laterals of the heat dissipating fins, and a heat dissipating module installed around the light emitting module and provided for dissipating heat; a fixing device, including a first fixing element and a second fixing element, both coupled to the heat dissipating module and embedded into the embedding grooves respectively, and having at least one fixing plate separately formed at edges of the first and second fixing elements respectively and fixed to the fixing seat.

To make it easier for our examiner to understand the technical characteristics, advantages and effects of the present invention, we use preferred embodiments accompanied with related drawings for the detailed description of the invention as follows.

DETAILED DESCRIPTION OF THE PREFERRED EMBODIMENTS

Figure 1:
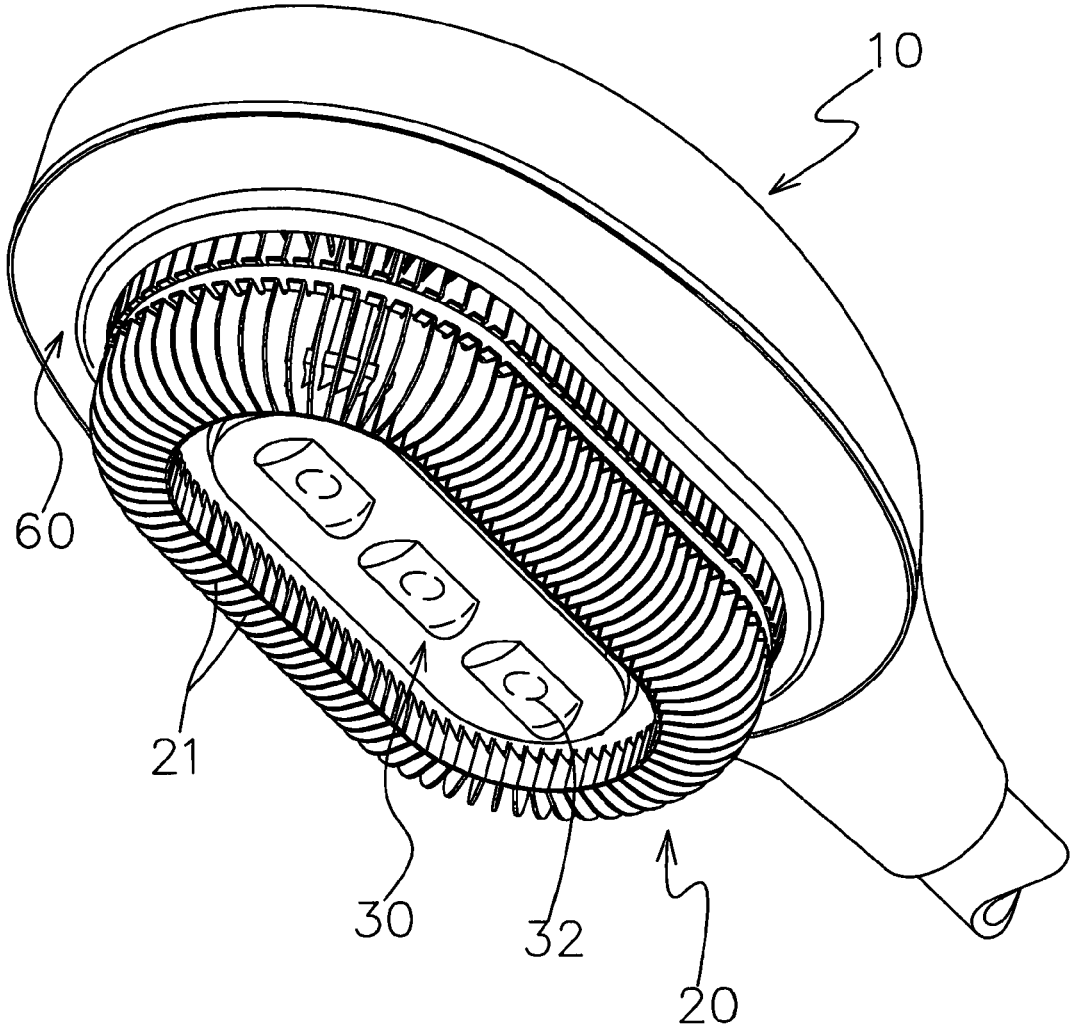
FIG. 1 is a perspective view of the present invention.
Figures 2, 2A:
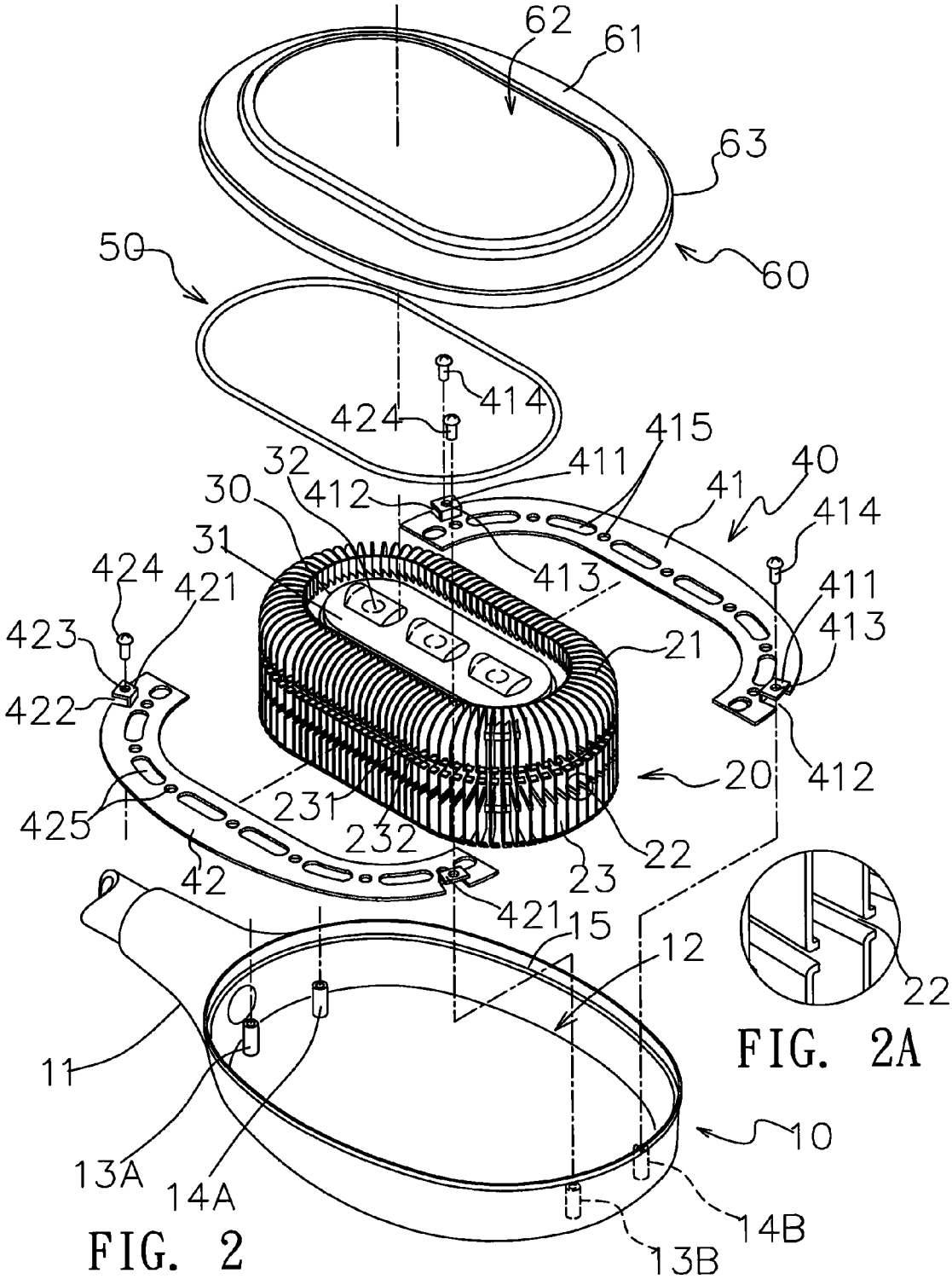
FIG. 2 is an exploded view of the present invention.
FIG. 2A is an enlarged cross-sectional view of a portion of FIG. 2.

With reference to FIGS. 1 and 2 for an apparatus for fixing an LED light engine in accordance with the present invention, the fixing apparatus comprises a lamp fixture device 10, a heat dissipating module 20, a light emitting module 30, an LED light engine fixing device 40 and an LED light engine mounting ring 50.

The LED light engine fixture device 10 includes a lamp fixture 11 having a containing space 12 provided for containing a plurality of fixing seats 13A, 14A and 13B, 14B (respectively disposed at both ends in this embodiment), and a concave snap ring 15 installed at the top of the containing space 12.

The heat dissipating module 20 includes a plurality of heat dissipating fins 21 integrally combined with each other (by a snapping method in this embodiment) to form a circular combination of the heat dissipating fins 21 with an interval apart from each other, and a mounting groove 23 and an embedding groove 22 concavely formed at upper and lower laterals of the heat dissipating fins 21 respectively. In this preferred embodiment, the mounting groove 23 has a larger space along the longitudinal direction than the embedding groove 22, and an upper mounting plate 231 and a lower mounting plate 232 are protruded from upper and lower ends of the mounting grooves 23 transversally and respectively, so that the mounting grooves 23 of the heat dissipating fins 21 constitute a circular mounting groove assembly, and the embedding grooves 22 of the heat dissipating fins 21 also constitute a circular embedding groove assembly. The light emitting module 30 includes a basal seat 31 with a plurality of light sources 32 (which are light emitting diodes in this embodiment), and the heat dissipating module 20 is installed around the light emitting module 30 and provided for dissipating heat.

The LED light engine composes of the light emitting module and the heat dissipating module as a whole unit.

Figure 4:
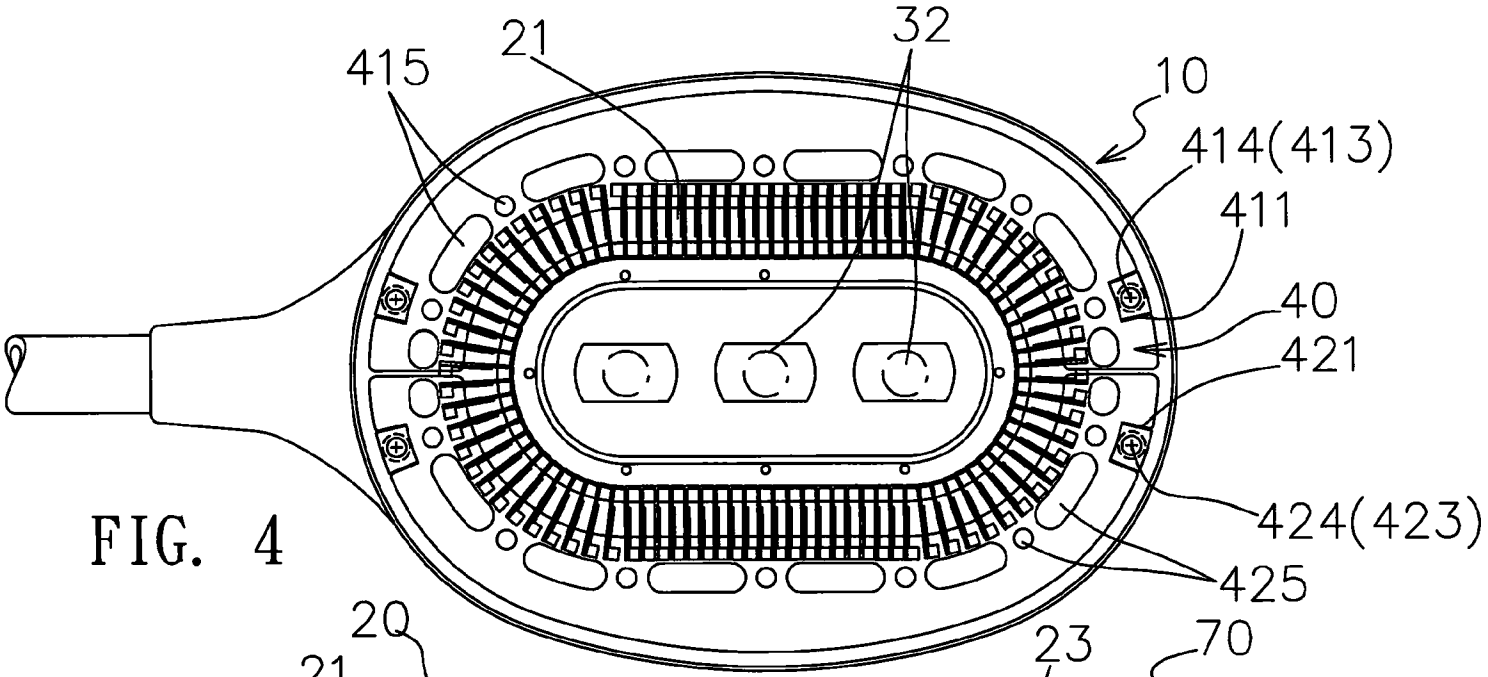
FIG. 4 is a top view of the present invention.
Figure 5:
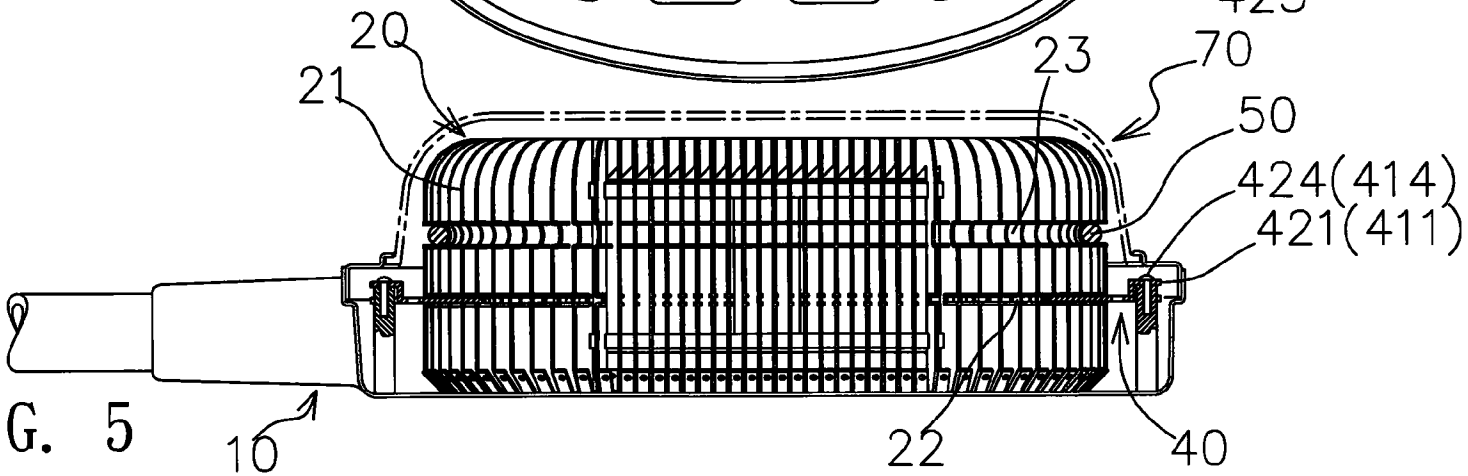
FIG. 5 is a side view of the present invention.

The LED light engine fixing device 40 includes a first fixing element 41 and a second fixing element 42 for coupling the heat dissipating module 20, wherein the first fixing element and second fixing element of this embodiment are substantially plate-shaped, and a fixing plate 411 separately protruded from both ends of the first fixing element 41. In this preferred embodiment, the fixing plate 411 is formed by stamping the first fixing element 41 and disposed in a concave space 412 below the fixing plate 411. The fixing plate 411 further includes a fixing hole 413, and the first fixing element 41 includes a plurality of through slots 415 formed thereon, and the second fixing element 42 includes a fixing plate 421 separately protruded from both ends of the second fixing element 42, and the fixing plate 421 is formed by stamping the second fixing element 42 and disposed in a concave space 422 below the fixing plate 421. The fixing plate 421 includes a fixing hole 423 formed thereon, and the second fixing element 42 includes a plurality of through slots 425 formed thereon, such that when the fixing device 40 is assembled, the first fixing element 41 and the second fixing element 42 are embedded into the embedding grooves 22 of the heat dissipating modules 20 by a clamping method, and the two fixing plates 411 of the first fixing element 41 correspond to fixing seats 14A, 14B of the lamp fixture base 11 respectively, and the two LED light engine fixing plates 421 of the second fixing element 42 correspond to fixing seats 13A, 13B of the lamp fixture base 11, and then are fixed by screw elements 414, 424 (such as bolts) respectively. In FIGS. 4 and 5, the first LED light engine fixing element 41 and the second LED light engine fixing element 42 embed and clamp the heat dissipating module 20 tightly, such that the entire heat dissipating module 20 comprised of the plurality of heat dissipating fins 21 can be positioned as shown in FIG. 3 and fixed to the containing space 12 of the lamp fixture base 11 by the fixing device 40.

Figure 3:
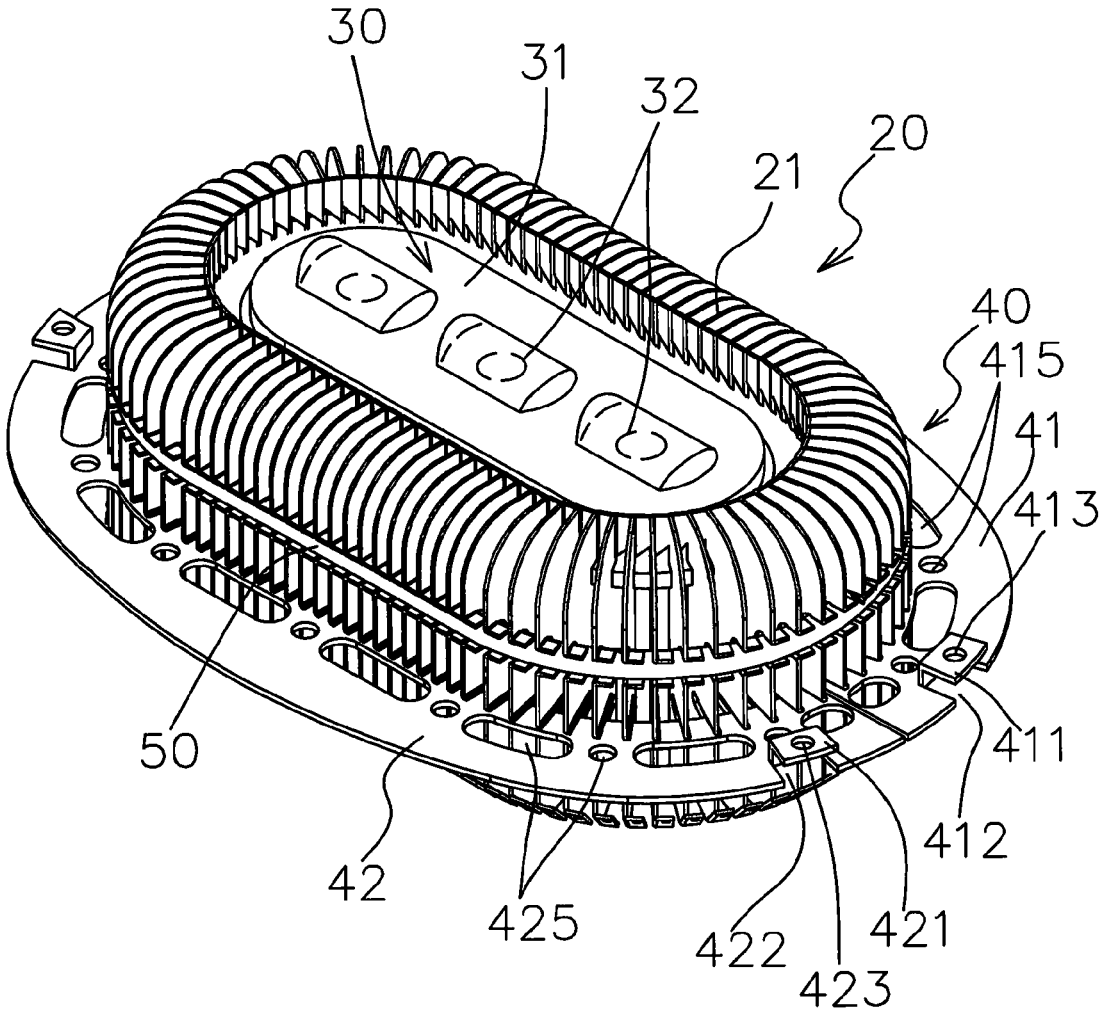
FIG. 3 is a perspective view of a heat dissipating module of the present invention.

The mounting ring 50 is substantially a circular body having a heat resisting property and mounted onto the mounting groove 23 of the heat dissipating module 20 as shown in FIG. 3 and provided for further fixing the heat dissipating module 20 into a position. Since an upper mounting plate 231 and a lower mounting plate 232 are installed at upper and lower ends of the mounting groove 23 respectively, the mounting ring 50 provides more spaces and convenience for the mounting operation to prevent the mounting ring 50 from being cut or damaged by the heat dissipating fins 21, so as to improve the durability and life span.

After the heat dissipating module 20 is assembled to the lamp fixture base 11, the lamp fixture base 11 may include a cover device 60 installed thereon, wherein the cover device 60 includes a cover body 61, a through portion 62 disposed at the central position of the cover body 61 for dissipating heat by an air convection, and a snap flange 63 formed at an edge of the cover body 61 and latched to the concave snap ring 15 of the lamp fixture base 11 for combining the cover body 61 with the lamp fixture base 11 as shown in FIG. 5.

When the apparatus for fixing an LED light engine in accordance with the present invention is assembled and applied, the heat dissipating module of the LED light engine can be positioned appropriately by the pair of first and second fixing elements and the mounting ring. After the first and second fixing elements are embedded, the first and second fixing elements can be screwed onto the lamp fixture base to provide a quick, simple and easy overall assembling operation. The invention not just meets the convenient installation requirement only, but also considers the repair and maintenance in the future to make the applications of the LED lighting devices using the traditional lamp fixture more practical and the construction much easier.

In summation of the description above, the present invention complies with patent application requirements, and thus is duly filed for patent application. While the invention has been described by means of specific embodiments, numerous modifications and variations could be made thereto by those skilled in the art without departing from the scope and spirit of the invention set forth in the claims.

What is claimed is:

1. An apparatus for fixing an LED light engine, comprising:

a lamp fixture, including a fixing seat disposed on a lamp fixture base; an LED light engine, composing of a light emitting module and a heat dissipating module a light emitting module, including a basal seat, and at least one light source arranged on the basal seat;

a heat dissipating module, including a plurality of heat dissipating fins with an interval apart from one another, and an embedding groove concavely formed at laterals of the heat dissipating fins, and the heat dissipating module being installed around the light emitting module and provided for dissipating heat; and an LED light engine fixing device, including a first fixing element and a second fixing element installed opposite to each other and combined with the heat dissipating module, and the first fixing element and the second fixing element being embedded, clamped and combined with the embedding groove, and at least one fixing plate separately formed at edges of the first fixing element and second fixing element and fixed to the fixing seat.

2. The apparatus for fixing an LED light engine as recited in claim 1, wherein the light source is a light emitting diode (LED).

3. The apparatus for fixing an LED light engine as recited in claim 1, wherein the lamp fixture base includes a containing space for containing the light emitting module.

4. The apparatus for fixing an LED light engine as recited in claim 1, wherein the fixing seat is installed in the containing space.

5. The apparatus for fixing an LED light engine as recited in claim 1, wherein the heat dissipating fin further includes a mounting groove concavely formed at a lateral of the heat dissipating fin, and each mounting groove is combined to form a circular mounting groove assembly.

6. The apparatus for fixing an LED light engine as recited in claim 1, further comprising a mounting ring mounted onto the embedding groove of the heat dissipating module.

7. The apparatus for fixing an LED light engine as recited in claim 1, wherein the mounting ring is made of a heat resistant material.

8. The apparatus for fixing a lamp fixture base as recited in claim 1, further comprising a cover body, a through portion disposed at a central position of the cover body, a snap flange formed at an edge of the cover body, and a concave snap ring installed at a top rim of a containing space for latching the snap flange.

9. The apparatus for fixing a lamp fixture base as recited in claim 1, wherein the fixing plate includes a concave space formed at the bottom of the fixing plate, and a fixing hole formed on the fixing plate for fixing the fixing seat.

10. The apparatus for fixing a lamp fixture base as recited in claim 1, wherein the first fixing element and second fixing element are substantially plate-shaped, and each of the first and second fixing elements includes a plurality of through slots.

* * * * *